US005167275A

United States Patent [19]

Stokes et al.

[11] Patent Number: 5,167,275

[45] Date of Patent: Dec. 1, 1992

[54] HEAT EXCHANGER TUBE WITH TURBULATOR

[76] Inventors: Bennie J. Stokes; Dyrell K. Stokes, both of 2615 Lena St., Sulphur, La. 70663

[21] Appl. No.: 446,858

[22] Filed: Dec. 6, 1989

[51] Int. Cl.[5] ..... F28F 13/06; B21C 37/26

[52] U.S. Cl. ..... 165/109.1; 165/179; 29/890.036; 29/890.037; 29/890.048

[58] Field of Search ..... 165/109.1, 179; 29/890.036, 890.037, 890.048, 890.053

[56] References Cited

U.S. PATENT DOCUMENTS

| | | | |
|---|---|---|---|
| 1,992,988 | 3/1935 | Blahnik | 165/109.1 |
| 2,318,206 | 5/1943 | Eisenlohr | 165/109.1 |
| 2,693,026 | 11/1954 | Simpelaar | 165/179 |
| 3,001,767 | 9/1961 | Straubing | 165/109.1 |
| 3,335,790 | 8/1967 | Aranyi et al. | 165/109.1 |
| 3,339,631 | 9/1967 | McGurty et al. | 165/109.1 |
| 3,477,412 | 11/1969 | Kitrilakis | 165/109.1 |
| 4,086,959 | 5/1978 | Habdas | 165/141 |
| 4,111,402 | 9/1978 | Barbini | 165/109.1 |
| 4,373,578 | 2/1983 | Saperstein et al. | 165/141 |
| 4,534,409 | 8/1985 | Cadars | 165/109.1 |
| 4,642,149 | 2/1987 | Harper | 165/160 |

FOREIGN PATENT DOCUMENTS

| | | | |
|---|---|---|---|
| 621980 | 6/1961 | Canada | 165/109.1 |
| 75325 | 1/1953 | Denmark | 165/109.1 |
| 695938 | 9/1940 | Fed. Rep. of Germany | 165/109.1 |
| 2352734 | 4/1975 | Fed. Rep. of Germany | 165/109.1 |
| 64496 | 4/1983 | Japan | 165/109.1 |
| 0932192 | 5/1982 | U.S.S.R. | 165/109.1 |
| 984156 | 2/1965 | United Kingdom | 165/109.1 |

*Primary Examiner*—John Rivell
*Assistant Examiner*—L. R. Leo
*Attorney, Agent, or Firm*—Jacobson, Price, Holman & Stern

[57] ABSTRACT

A heat exchange tube is provided and includes a turbulator therein incorporating a tubular center core and a spiral wrap about the core. The turbulator is first inserted within the heat exchange tube with minimum clearance between the spiral wrap and the internal surfaces of the tube and minimum clearance between the spiral wrap and the tubular core. Thereafter, the tubular core is expanded sufficiently to deform those portions of the spiral wrap engaging the core and also those portions of the spiral wrap engaging the inner surfaces of the heat exchange tube.

4 Claims, 1 Drawing Sheet

HEAT EXCHANGER TUBE WITH TURBULATOR

BACKGROUND OF THE INVENTION

1. Field of the Invention

This invention relates to a heat exchange tube having an internal turbulator therein including a generally longitudinally straight core member and a second elongated member spirally wrapped about the core member. The assembly comprising the core member and the second member is inserted lengthwise into a heat exchanger tube with minimum clearance between the spirally wrapped member, the core member and the internal surfaces of the tube. Thereafter, the core member is expanded into tight engagement with the spirally wrapped member and to an extent that the spirally wrapped member also is expanded into tight engagement with the inner surfaces of the tube member.

2. Description of Related Art

Various different forms of heat exchanger tubes and heat exchange inserts heretofore have been provided for increasing the heat transfer capacity of a heat transfer tube.

Examples of previously known structures of this type are disclosed in U.S. Pat. Nos. 2,318,206, 4,086,959, 4,373,578, 4,534,409 and 4,642,149. However, these previously known devices do not include the structural and operational features of the instant invention, nor are they as readily constructed at low cost.

SUMMARY OF THE INVENTION

The heat exchanger tube of the instant invention includes an internal turbulator which functions to cause heat exchange fluid passing through the tube to travel a greater distance in heat exchange relation contact with the internal surfaces of the heat exchanger tube, thus appreciably increasing the heat exchange capacity of the tube.

The main object of this invention is to provide a heat exchange tube construction which will be capable of increasing the heat exchange rate between fluid passing through the tube and fluid passing over the exterior of the tube.

Another object of this invention is to provide a heat exchange tube utilizing an internal turbulator to increase the heat exchange capacity thereof and a turbulator which may be utilized in conjunction with smooth walls of cylindrical heat exchanger tubes.

Another important object of this invention is to provide a turbulator which may be readily inserted into straight length of heat exchange tubing.

Another important of this invention is to provide a heat exchange tube turbulator which may be inexpensively constructed from readily available components.

Another very important object of this invention is to provide a heat exchange tube turbulator constructed in a manner enabling the turbulator to be radially expanded into tight engagement with the internal surfaces of a cylindrical heat exchange tube to thereby increase the heat exchange rate between the turbulator itself and the heat exchange tube.

A further object of this invention is to provide a heat exchange turbulator in accordance with the preceding objects and which, when expanded after insertion into the associated heat exchange tube, is deformed in the areas of contact with the interior surfaces of the heat exchanger tube in order to increase the heat exchange path therebetween.

Yet another very important object of this invention is to provide a heat exchange tube turbulator which is expanded subsequent to initial insertion into a heat exchanger tube in a manner such that the turbulator is tightly held in position within the heat exchange tube.

A final object of this invention to be specifically enumerated herein is to provide a heat exchanger tube with an internal turbulator and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Referring now more specifically to the drawings the numeral 10 generally designates a heat exchanger including a plurality of heat transfer tubes 12 and 14. The heat exchanger tubes 12 and 14 are similarly constructed and include opposite ends opening through header plates 16 and 18 over which suitable end tanks (not shown) may be secured. Alternately, one pair of corresponding ends of the heat exchange tubes 12 and 14 may be interconnected by a U-shaped tube section and the other ends of the tubes 12 and 14 ma be similarly connected to adjacent heat exchanger tubes (not shown).

Figure 1:
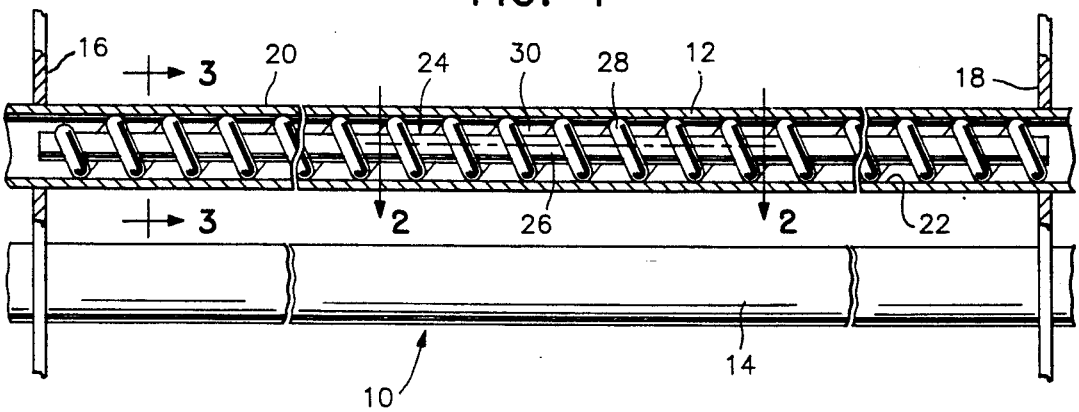
FIG. 1 is a fragmentary elevational view of a portion of a heat exchanger employing heat exchange tubes extending between end plates and with a portion of the illustrated heat exchanger broken away and illustrated in vertical section.
Figure 2:
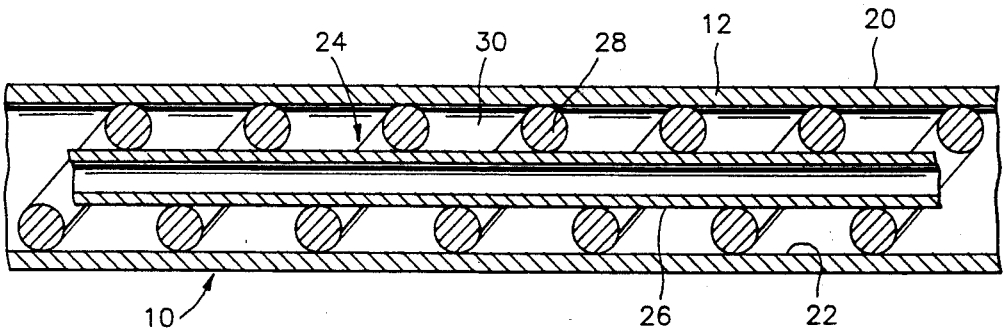
FIG. 2 is an enlarged horizontal sectional view taken substantially upon the plane indicated by the section line 2—2 of FIG. 1.
Figure 3:
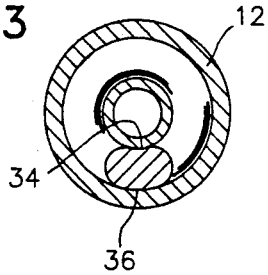
FIG. 3 is an enlarged fragmentary vertical sectional view taken substantially upon the plane indicated by the section line 3—3 of FIG. 1.
Figure 4:
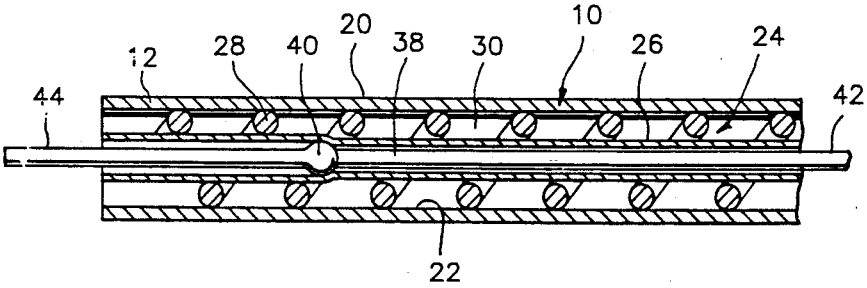
FIG. 4 is a fragmentary sectional view similar to FIG. 2 but illustrating the manner in which the center tubular core member of the turbulator within the heat exchanger tube is radially expanded into tight frictional engagement with the member spiral wrapped thereabout and in a manner sufficient to radially expand the spiral wrap into tight frictional engagement with the internal surfaces of the heat exchanger tube.

As may be seen from FIGS. 2 and 3 the heat exchange tube 12 comprises a cylindrical member including a smooth cylindrical outer surface 20 (which may include cooling fins) and a smooth cylindrical inner surface. The tube 12 is constructed of any suitable material having good heat transfer properties and the tube 12 has an elongated turbulator structure referred in general by the reference number 24 disposed therein. The turbulator structure 24 includes an elongated center core member 26 of tubular construction and which also is constructed of a material having good heat transfer properties. In addition, the turbulator structure 24 includes an elongated member 28 spirally wrapped about the core member 26. The convolutions of the elongated member 28 are open and, thus, a spiral passage 30 is defined about the central core member 26 between the convolutions of the member 28.

Upon the assumption that fluid is forced longitudinally through the heat exchange tube 12 and that a second heat exchange liquid passes over the external surfaces of the heat exchange tube 12, a heat transfer relationship is defined between the fluid passing through the interior of the tube 12 and the fluid passing over the exterior of the tube 12.

The fluid passing through the interior of the tube 12 is forced to pass through the spiral path 30 and, therefore, the fluid passing through the spiral passage 30 travels a distance equal to at least twice the length of travel of the fluid along the length of the heat exchange tube 12. Of course, if the convolutions of the member 28 are more closely spaced together, the distance traveled through the passage 30 will be even greater in relation to the movement of the fluid along the length of the heat exchange tube 12.

In order to insure that the turbulator structure 24 may be reasonably easily positioned within the tube 12, the outside diameter of the spiral wrap comprising the member 28 is slightly, only, smaller than the inside diameter of the tube 12, the outside diameter of the core member 26 being substantially the same as the inside diameter of the spiral wrap comprising the elongated member 28. Thereafter, after the turbulator structure 24 is positioned as desired, the core member 26 is forcibly expanded sufficiently to also expand the spiral wrap comprising the member 28 relative to the tube 12. The expansion of the core member 26 is such that the contacting portions of the elongated member 28 are deformed as at 34 to increase the surface contact area between the core member 26 and the member 28 and the area of contact of the member 28 with the inner surface 22 of the tube 12 is deformed as at 36 to also increase the area of contact between the member 28 and the tube 12. In addition to increasing the areas of contact between the elongated member 28 and the core member 26 and tube 12, a substantially fluid tight joint is formed between the elongated member 28 and the contacting portions of the core member 26 and tube 12. Thus, the heat exchange fluid passing through the spiral space 30 is restricted to the latter.

The elongated member 28 is more readily deformed than the core member 26 and the heat exchange tube 12. This will prevent substantially all deformation of the heat exchange tube 12 and any heat exchange fins (not shown) which may be supported from the exterior of the tube 12.

Although there may be several different methods by which the core member 26 may be sufficiently expanded to deform the elongated member 28 in the manner illustrated in FIG. 3, one method of expanding the core member 26 is to force a mandrel 38 longitudinally through the core member 26, the mandrel including an enlarged portion 40 thereon. The mandrel 38 may be pulled through the core member 26 through utilization of an integral pull rod section 42 or pushed through the core member 26 through utilization of a push rod section 44. Also, fluid pressure may be applied to the interior of the core member 26 in order to effect the necessary expansion thereof. If internal fluid pressure is used to expand the core member 26, the core member 26 will be more greatly expanded into the spiral space 30 than at the points of contact with the spiral wrap comprising the elongated member 28. Accordingly, the effective cross sectional area of the spiral path 30 will be further reduced. Thus, the volume of flow through the spiral path 30 will be reduced, assuming the same pressure differential between the inlet and outlet ends of the heat exchange tube 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A heat exchange tube construction including an elongated outer tube constructed of good heat transfer material and having inner and outer surfaces, an elongated core member centrally disposed in said outer tube and extending longitudinally thereof with outer surface portions of said core member spaced inwardly from opposing inner surface portions of said outer tube, and a third elongated member spirally wrapped about said core member within said outer tube with opposing surfaces of said third elongated member and said inner surface and outer surface portions being at least tightly engaged with each other to at least substantially eliminate fluid flow therebetween, said elongated core member being tubular and constructed of good heat transfer material, said elongated tubular core member being radially expanded into tight engagement with the opposing portions of said third elongated member and the latter being sufficiently yieldable to thereby be radially expanded into tight engagement with said opposing inner surface portions of said outer tube, said outer tube being constructed of a material less yieldable than said third elongated member, whereby expansion of said tubular core member relative to said third elongated member and expansion of said third elongated member relative to said outer tube causes deformation of said third elongated member at points of contact with said core member and outer tube to thereby increase the respective areas of contact therewith.

2. The heat exchange tube construction of claim 1 wherein said third elongated member is constructed of good heat transfer material and is disposed in good heat transfer relation with the opposing inner surface portions of said outer tube.

3. The method of providing a tubular heat exchange tube with a greater heat transfer capacity between a fluid flowing through said tube and a fluid flow over the exterior of said tube, said method including:

(a) inserting an elongated turbulator structure within said tube from either end thereof and with said turbulator structure extending longitudinally of said tube and including an elongated center tubular core and a elongated spiral wrap member disposed about said core with said spiral wrap member and tubular core closely received within said heat exchange tube and spiral wrap member, respectively; and (b) expanding said tubular core outwardly into tight engagement with the opposing portions of said spiral wrap member and sufficiently to also expand said spiral wrap member outwardly into tight engagement with the inner surfaces of said tube.

4. The method claim 3 wherein said spiral wrap member is constructed of a material more readily deformed than the materials of which said tubular core and tube are constructed and the expansion of the tubular core in (b) is sufficient to appreciably deform said spiral wrap in the areas thereof contacting said tubular core and heat exchange tube to thereby increase the area of contact of said spiral wrap with said tubular core and heat exchange tube.

* * * * *